US011849296B2

(12) United States Patent
Akiyama et al.

(10) Patent No.: US 11,849,296 B2
(45) Date of Patent: Dec. 19, 2023

(54) VIBRATION DEVICE FOR GENERATING ACOUSTIC PERFORMANCE

(71) Applicant: AGC Inc., Tokyo (JP)

(72) Inventors: Jun Akiyama, Tokyo (JP); Kento Sakurai, Tokyo (JP)

(73) Assignee: AGC Inc., Tokyo (JP)

( * ) Notice: Subject to any disclaimer, the term of this patent is extended or adjusted under 35 U.S.C. 154(b) by 107 days.

(21) Appl. No.: 17/304,669

(22) Filed: Jun. 24, 2021

(65) Prior Publication Data

US 2021/0314706 A1 Oct. 7, 2021

Related U.S. Application Data

(63) Continuation of application No. PCT/JP2019/050373, filed on Dec. 23, 2019.

(30) Foreign Application Priority Data

Dec. 27, 2018 (JP) ..... 2018-246215

(51) Int. Cl.
*H04R 7/04* (2006.01)
*B06B 1/04* (2006.01)
*B06B 1/02* (2006.01)

(52) U.S. Cl.
CPC ..... *H04R 7/045* (2013.01); *B06B 1/0207* (2013.01); *B06B 1/045* (2013.01); *H04R 2440/05* (2013.01)

(58) Field of Classification Search
CPC ..... H04R 7/045; H04R 2440/05
See application file for complete search history.

(56) References Cited

U.S. PATENT DOCUMENTS 6,478,109 B1 * 11/2002 Kam ..... H04R 7/20 181/177
2007/0092092 A1 4/2007 Kondo et al.
(Continued)

FOREIGN PATENT DOCUMENTS

JP 05-227590 A 9/1993
JP 2007-116422 A 5/2007
(Continued)

OTHER PUBLICATIONS

English machine translation of JP 2018-170593 (Hayashi et al., Glass Plate Structure, published Nov. 2018) (Year: 2018).*
(Continued)

*Primary Examiner* — Mark Fischer
(74) *Attorney, Agent, or Firm* — Oblon, McClelland, Maier & Neustadt, L.L.P.

(57) ABSTRACT

A vibration device includes a plate-like glass vibrator and a plurality of exciters that are attached to the glass vibrator and configured to generate vibration according to an input electrical signal. An aspect ratio La/Lb of a length La of a longer side to a length Lb of a shorter side of a rectangle in which the glass vibrator is inscribed is 1.2 to 50. Provided that the number of the exciters is n and a minimum value of distance between the exciters is $S_{min}$, a relational value α ($\alpha=S_{min}-1)/La$) is 0.2 to 0.8. In the case where the number n of exciters is 3 or larger, a value β($\beta=S\sigma/S_{ave}$) obtained by dividing a standard deviation Sσ of distances by an average $S_{ave}$ of the distances between the exciters is 0 to 0.5.

20 Claims, 10 Drawing Sheets

(56) References Cited

U.S. PATENT DOCUMENTS

| | | | | |
|---|---|---|---|---|
| 2008/0226109 | A1* | 9/2008 | Yamakata | G10K 13/00 381/339 |
| 2016/0241689 | A1* | 8/2016 | Watanabe | H04R 17/00 |
| 2021/0014449 | A1* | 1/2021 | Maeshiba | H04R 7/08 |

FOREIGN PATENT DOCUMENTS

| | | | |
|---|---|---|---|
| JP | 2008-219202 | A | 9/2008 |
| JP | 2018-170593 | A | 11/2018 |

OTHER PUBLICATIONS

International Search Report dated Feb. 10, 2020 in PCT/JP2019/050373 filed on Dec. 23, 2019, 2 pages.

Mal et al., "A Novel Glass Laminated Structure for Flat Panel Loudspeakers", AES Convention 124, 7343, 2008, 6 pages.

* cited by examiner

VIBRATION DEVICE FOR GENERATING ACOUSTIC PERFORMANCE

TECHNICAL FIELD

The present invention relates to a vibration device for exciting a glass vibrator.

BACKGROUND ART

Cone paper and resin are used broadly to form diaphragms for speakers and microphones. Being large in loss coefficient and less prone to resonance vibration, these materials are high in sound reproduction performance in the audible range. However, since these materials are themselves low in acoustic velocity, when they are excited at a radio frequency, vibration occurring in the materials does not easily follow a sound wave frequency, possibly causing divided vibration. As a result, these materials cause difficulty producing a desired sound pressure particularly in a radio frequency range.

On the other hand, recent high-resolution sound sources etc. are required to reproduce sound in such a radio frequency range as to be less audible to human ears (in particular, 20 kHz or higher). If sound wave vibration in such a radio frequency range is reproduced faithfully, sound can be obtained that rouses emotion more, for example, causes a listener to feel a strong sense of presence. In these circumstances, it is being studied to use, to produce a diaphragm, instead of cone paper or resin, materials that are high in the speed of sound they propagate, such as metals, ceramic, and glass.

Among such materials are a single glass sheet for a speaker diaphragm (Patent document 1) and laminate glass in which a 0.5-mm-thick polybutyl-type polymer layer is sandwiched between two glass sheets (Non-patent document 1).

CITATION LIST

Patent Literature

Patent document 1: JP-A-5-227590

Non-Patent Literature

Non-patent document 1: Olivier Mal et. al., "A Novel Glass Laminated Structure for Flat Panel Loudspeakers," AES Convention 124, 7343.

SUMMARY OF INVENTION

Technical Problems

In general, because of limitations such as one relating to acoustic efficiency, diaphragms for speakers and microphones having circular or elliptical (near-circular) shapes are being used broadly. However, the installation space of a diaphragm is restricted when it is used as a vehicular or onboard component or installed in a building. Particular in the case where an installation space has a long and narrow shape in which the length and width are greatly different, almost no such diaphragms have been used and they were insufficient in sound reproduction performance, acoustic effect, etc.

That is, it is difficult to excite a diaphragm stably whose length and width are greatly different while allowing it to exhibit sufficient acoustic performance.

An object of the present invention is to provide a vibration device that can be excited stably while sufficient acoustic performance is maintained even in the case where the length and width are greatly different.

Solution to Problem

The present inventors have studied diligently and completed the invention by finding that the above problems can be solved by a prescribed glass sheet composite.

That is, the invention is as described below:

(1) A vibration device including a plate-like glass vibrator and a plurality of exciters that are attached to the glass vibrator and configured to generate vibration according to an input electrical signal, wherein an aspect ratio La/Lb of a length La of a longer side to a length Lb of a shorter side of a rectangle in in which the glass vibrator is inscribed is 1.2 or larger and 50 or less, wherein provided that the number of the exciters is n, a minimum value of distance between the exciters is $S_{min}$, and a relational value between the number n of exciters and the minimum value $S_{min}$ of distance between the exciters is $\alpha$ ($\alpha=S_{min}(n-1)/La$), the $\alpha$ is 0.2 or larger and 0.8 or less, and wherein in the case where the number n of exciters is 3 or larger, a value $\beta$($\beta=S\sigma/S_{ave}$) obtained by dividing a standard deviation $S\sigma$ of distances between the exciters by an average $S_{ave}$ of the distances between the exciters is 0 or larger and 0.5 or less.

(2) The vibration device according to item (1), wherein the glass vibrator has a loss coefficient at 25° C. of $1\times10^{-2}$ or larger, and a longitudinal wave acoustic velocity in a thickness direction of the glass vibrator of $5.0\times10^{3}$ m/s or higher.

(3) The vibration device according to item (1) or (2), wherein the glass vibrator includes two or more glass sheets and a fluid layer including liquid disposed between at least a pair of glass sheets among the glass sheets.

(4) The vibration device according to any one of items (1) to (3), including a housing that covers at least one surface of the glass vibrator, wherein the exciters are disposed in an internal space of the housing.

(5) The vibration device according to item (4), wherein each of the exciters is fixed to the glass vibrator on one side and fixed to the housing on the other side.

(6) The vibration device according to item (4) or (5), wherein the housing has an air hole formed to communicate the internal space of the housing with an outside of the housing.

(7) The vibration device according to any one of items (4) to (6), including a sound absorbing member that is provided in the internal space of the housing.

(8) The vibration device according to any one of items (1) to (7), having a sound pressure variation in a frequency of 200 Hz to 10 kHz of 20 dB or less.

(9) The vibration device according to any one of items (1) to (8), wherein at least a part of the glass vibrator has a concave or convex curved surface.

(10) The vibration device according to any one of items (1) to (9), wherein the glass vibrator includes a reinforcement member that extends along a longitudinal direction of the glass vibrator.

Advantageous Effects of Invention

The invention provides a vibration device that can be excited stably while sufficient acoustic performance is maintained even in the case where the length and width of the diaphragm are greatly different.

DESCRIPTION OF EMBODIMENTS

Figure 1:
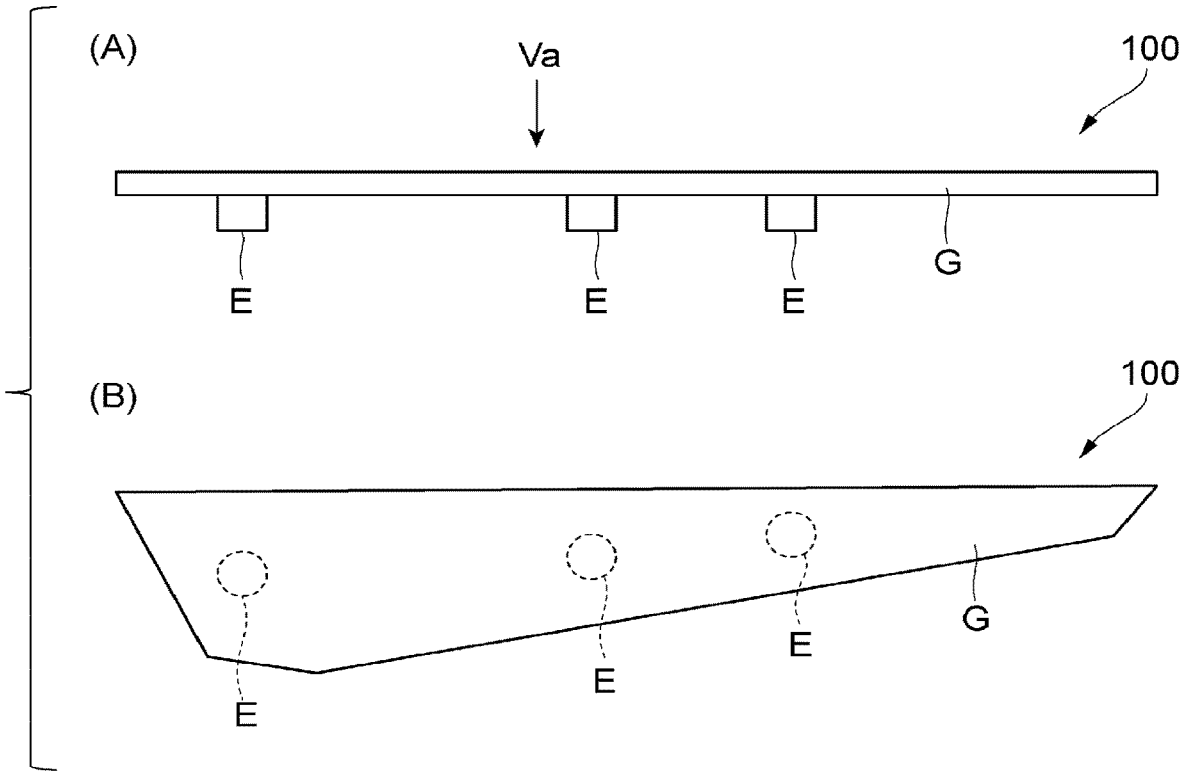
FIG. 1 illustrates schematic views of a vibration device; (A) is a side view and (B) is a front plan view.

The details and other features of the invention are hereinafter described on the basis of embodiments of the invention. In the drawings to be referred to below, members or components that are identical or correspond to each other are given the same symbol or corresponding symbols and redundant descriptions therefor are omitted. The drawings are not intended to show relative sizes between members or components unless otherwise specified. Thus, specific dimensions can be selected as appropriate by referring to the following non-restrictive embodiments.

In the specification, the mark "-" (or the word "to") that is used to indicate a numerical range indicates a range that includes the numerical values written before and after it as a lower limit value and an upper limit value, respectively.

<Configuration of Vibration Device>

FIG. 1 illustrates schematic views of a vibration device; (A) is a side view and (B) is a front plan view.

A vibration device 100 has a light-transmissive plate-like glass vibrator G and a plurality of exciters E which are attached to the glass vibrator G and generate vibration according to an input electrical signal.

The glass vibrator G, whose detailed structure is described later, generates sound when excited by vibration generated by the exciters E. The glass vibrator G may have a transparency that the opposite side is seen through it when viewed from the direction indicated by arrow Va in (A) of FIG. 1, or may have a light-shielding property or selective light-transmissive property (an optical filter such as a band-pass filter or a surface treatment layer having a light diffusion surface). The glass vibrator G may be a single-sheet substrate or may be a glass sheet composite (described later in detail) including a plurality of substrates. It is preferable that the glass vibrator G be made of a material that is high in longitudinal wave acoustic velocity. For example, a glass sheet, light-transmissive ceramic, or a single crystal such as sapphire may be used.

Although not shown in any drawing, each exciter E includes a coil portion that is electrically connected to an external device, a magnetic circuit portion, and an exciting portion that is connected to the coil portion or magnetic circuit portion. When an electrical signal representing sound is input to the coil portion from the external device, vibration is generated in the coil portion or the magnetic circuit portion through interaction between the coil portion and the magnetic circuit portion. The vibration of the coil portion or the magnetic circuit portion is transmitted to the exciting portion and then transmitted from the exciting portion to the glass vibrator G.

A plurality of the exciters E are attached to the glass vibrator G. In this example configuration, three exciters E are attached to one surface of the glass vibrator G so as to be spaced from each other in the longitudinal direction of the glass vibrator G.

Figure 2:
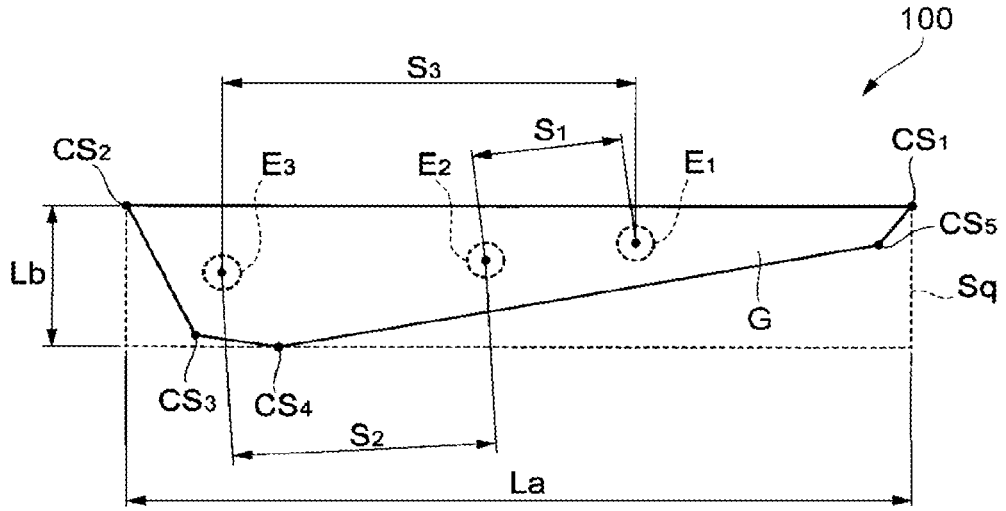
FIG. 2 illustrates an explanatory diagram showing a shape of a glass vibrator of the vibration device.

FIG. 2 is an explanatory diagram showing a shape of the glass vibrator G of the vibration device 100.

The glass vibrator G is shaped like a long and narrow polygon in a plan view. In this example configuration, the glass vibrator G assumes a pentagonal shape having five corners $CS_1$-$CS_5$. A rectangle Sq in which the glass vibrator G is inscribed shown in FIG. 2 is shaped like a long and narrow rectangle that is in contact with the corners $CS_1$, $CS_2$, and $CS_4$. The rectangle Sq can be defined as a smallest rectangle whose longer side corresponds to the longest side of the glass vibrator G and in which the outer circumference of the glass vibrator G is inscribed.

When the length of the longer side and the length of the shorter side of the rectangle Sq in which the glass vibrator G is inscribed are represented by La and Lb, respectively, the aspect ratio La/Lb which is longer side to shorter side dimension ratio of the rectangle Sq is 1.2 or larger and 50 or less. The upper limit of the aspect ratio is preferably 45 or less, even preferably 40 or less. The lower limit of the aspect ratio is preferably 5.0 or larger, even preferably 10 or larger.

The number of exciters E attached to the glass vibrator G is represented by n, the minimum distance between the exciters E is represented by $S_{min}$, and the relational value between the number n of exciters E and the minimum distance $S_{min}$ between the exciters E is represented by $\alpha(\alpha=S_{min}(n-1)/La)$.

In this case, the $\alpha$ of the vibration device 100 is preferably 0.2 or larger and 0.8 or less. The $\alpha$ is preferably 0.75 or less, even preferably 0.7 or less, as the upper limit. The $\alpha$ is preferably 0.25 or larger, even preferably 0.3 or larger, as the lower limit.

The glass vibrator G shown in FIGS. 1 and 2 has three exciters E1, E2, and E3 and the distances between these exciters E1, E2, and E3 are S1 (E1-E2 distance), S2 (E2-E3 distance), and S3 (E3-E1 distance). Thus, in this configuration, the number n of exciters E is 3 and the minimum distance $S_{min}$ between the exciters E is S1. The value α that correlates the number n of exciters E and the minimum distance $S_{min}$ between the exciters E is represented as α=S1 (3−1)/La, and the relational value satisfies the relationship $0.2 \leq \alpha \leq 0.8$.

In the vibration device 100, when the number n of exciters E is larger than or equal to 3, the value β (β=Sσ/$S_{ave}$), that is obtained by dividing the standard deviation Sσ of the distances between the exciters E by the average value $S_{ave}$, is 0 or larger and 0.5 or less. In this configuration, since the number n of exciters E is 3, the value obtained by dividing the standard deviation Sσ of the distances S1, S2, and S3 between the exciters E by their average $S_{ave}$ is 0 or larger and 0.5 or less. That is, since the exciters E which are attached to the glass vibrator G are arranged as evenly as possible in the longitudinal direction of the glass vibrator G, the long and narrow glass vibrator G can be excited in a well-balanced manner, whereby sound can be output with stable sound pressure.

Figure 3:
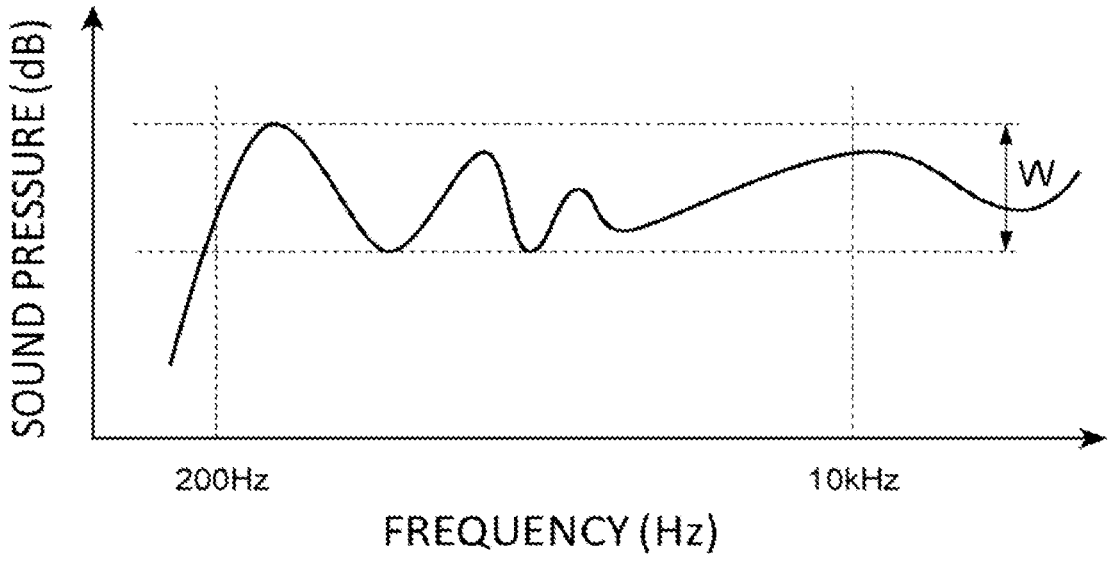
FIG. 3 illustrates a graph showing a relationship between the frequency and the sound pressure of the vibration device.

FIG. 3 is a graph showing a relationship between the frequency and the sound pressure of the vibration device 100.

The sound pressure variation value w in a frequency range 200 Hz to 10 kHz obtained by vibrating the glass vibrator G of the vibration device 100 is preferably 20 dB or less. The sound pressure variation value w is even preferably 10 dB or less, further preferably 5 dB or less. Since as described above the sound pressure variation value w in the frequency range 200 Hz to 10 kHz is less than or equal to the above limit value, high-quality sound that is reduced in noise is output from the glass vibrator G at uniform sound pressure. Sound can be output at stable sound pressure by providing a plurality of exciters and controlling the input energy and the signal phase for each exciter so as to minimize the sound pressure level variation. In particular, in the invention, the sound pressure variation can be suppressed to 20 dB or less easily and stably by employing the configuration of the vibration device according to the invention. The input energy and the signal phase can be controlled by, for example, using a known control device such as a DSP and a known control method.

According to the vibration device 100 having the above configuration, satisfactory acoustic performance can be obtained stably by exciting the long and narrow glass vibrator G having s a large aspect ratio, that is, having a greatly different length and width dimensions, by the a plurality of exciters E. As such, the vibration device 100 can be used suitably as a member of an electronic device, an interior vibration member of a transport machine such as a vehicle, a vehicular or onboard speaker, or an opening member used in, for example, a construction or transport machine.

The glass vibrator G of the vibration device 100 may be shaped like a flat plate, and it may have any of various shapes according to the shape etc. of an installation place. For example, the glass vibrator G may have a three-dimensional shape such as a convex shape that projects in the thickness direction, a concave shape that is recessed in the thickness direction, or a twisted shape, or a shape obtained by combining some of these shapes in an appropriate manner. Furthermore, such a three-dimensional shape may be formed so as to have a smooth curved surface or in such a manner that many flat portions are connected to each other in a step-like manner. Furthermore, the glass vibrator G may have both of such a three-dimensional portion and a flat-plate.

Figure 4:
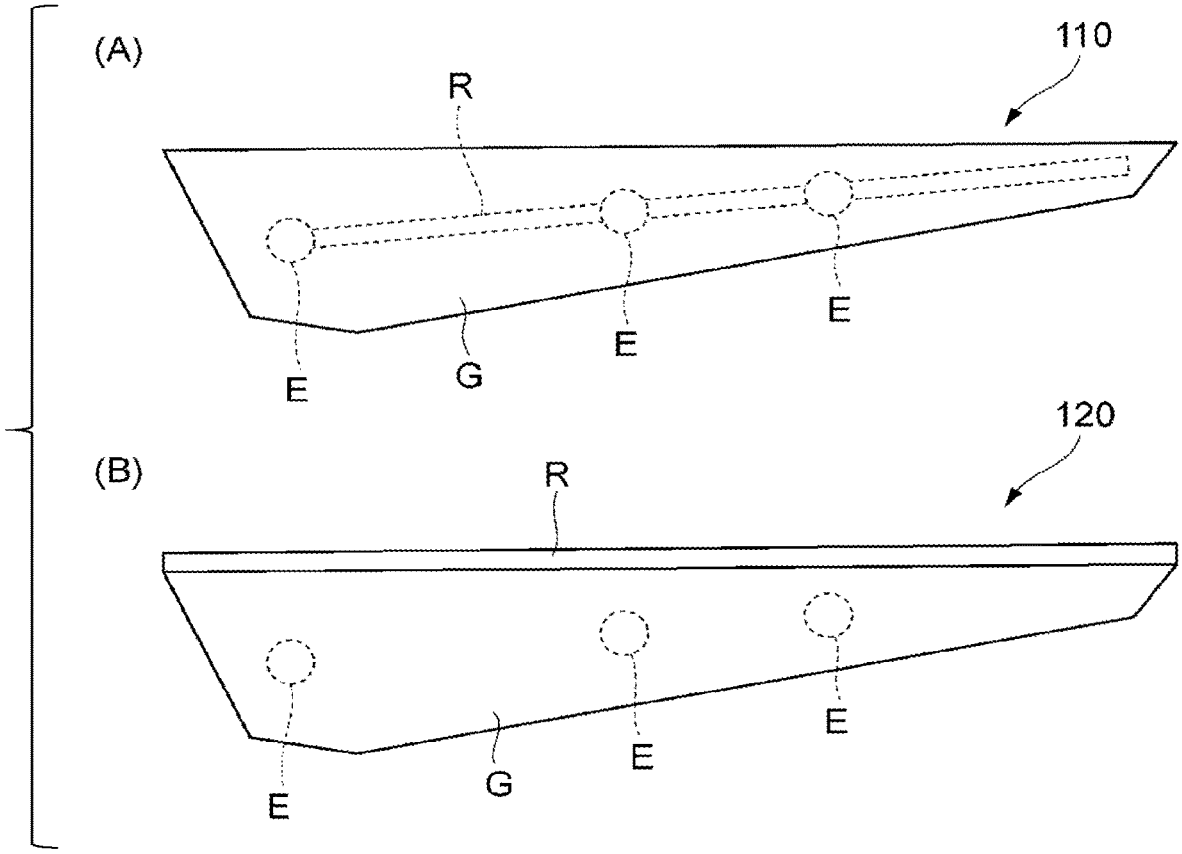
FIG. 4 illustrates schematic diagrams; (A) and (B) are schematic diagrams showing vibration devices including the glass vibrator which has a reinforcement member.

FIG. 4 illustrates schematic views; (A) and (B) are schematic diagrams showing respective vibration devices 110 and 120 each of which has a reinforcement member.

The glass vibrator G may have a reinforcement member R. The reinforcement member R is shaped like a rod and is provided so as to extend along the longitudinal direction of the glass vibrator G. By providing the reinforcement member R, the glass vibrator G is reinforced in the longitudinal direction in which it is required to be high in strength. The reinforcement member R may be fixed to the exciters E as shown in (A) of FIG. 4 or disposed at different positions than the exciters E as shown in (B) of FIG. 4. In this case, a reinforcement member R that is separate from the glass vibrator G may be fixed to the glass vibrator G. Alternatively, a reinforcement member R may be molded so as to be unified with the glass vibrator G; for example, a part of the glass vibrator G may be made a thick portion, which is employed as the reinforcement member R.

The glass vibrator G is described in more detail.

<Glass Vibrator G>

As described later in detail, the glass vibrator G which is a member of the vibration device 100 preferably has a loss coefficient at 25° C. of $1\times10^{-2}$ or larger and its longitudinal wave acoustic velocity of $5.0\times10^{3}$ m/s or higher. The expression "the loss coefficient is large" means that the vibration damping capacity is high.

As for the loss coefficient, a value calculated by a half-width method is used. Denoting f as the resonant frequency of a material and W as a frequency width at a point decreased by −3 dB from the peak value of the amplitude h (namely, the point of (maximum amplitude) −3 [dB]), the loss coefficient is defined as a value represented by {W/f}.

In order to prevent the resonance, the loss coefficient may be increased, namely, this means that the frequency width W becomes relatively large with respect to the amplitude h and the peak becomes broader.

The loss coefficient is specific to a material or the like. For example, in the case of a simple glass sheet, the loss coefficient varies depending on its composition, relative density, etc. A loss coefficient can be measured by a dynamic elasticity modulus test method such as a resonance method.

The longitudinal wave acoustic velocity means a propagation speed of longitudinal waves through a diaphragm. A longitudinal wave acoustic velocity and a Young's modulus can be measured by an ultrasonic pulse method prescribed in JIS-R1602-1995.

As for a specific structure for obtaining a large loss coefficient and a high longitudinal wave acoustic velocity, it is preferable that the glass vibrator G include two or more glass sheets and also include a prescribed fluid layer between at least a pair of glass sheets among the glass sheets.

(Fluid Layer)

A large loss coefficient of the glass vibrator G can be realized by providing a fluid layer containing liquid between at least a pair of glass sheets. In particular, an even larger loss coefficient can be obtained by setting the viscosity and the surface tension of the fluid layer in preferable ranges. This is considered because of the fact that the pair of glass sheets are not fixed to each other and each glass sheet continues to exhibit its vibration characteristic unlike in a case that a pair of glass sheets are provided via an adhesive layer. In this specification, the term "fluid" means anything that includes a liquid such as a liquid, a mixture of a solid powder and a liquid, and a solid gel (jelly-like substance) impregnated with liquid.

The viscosity coefficient at 25° C. of the fluid layer is preferably $1\times10^{-4}$ to $1\times10^{3}$ Pa·s, and the surface tension of the fluid layer at 25° C. is preferably 15-80 mN/m. If the viscosity is too low, vibration less tends to transmitted. If the viscosity is too high, the pair of glass sheets located on the two respective sides of the fluid layer are fixed to each other and come to exhibit vibratory behavior like a single glass sheet does, and resonance vibration less tends to attenuate. If the surface tension is too weak, the adhesion between the pair of glass sheets becomes so weak that vibration less tends to transmitted. If the surface tension is too large, the pair of glass sheets located on the two respective sides of the fluid layer are prone to be fixed to each other and come to exhibit vibratory behavior like a single glass sheet does, and resonance vibration less tends to attenuate.

The viscosity coefficient at 25° C. of the fluid layer is more preferably $1\times10^{-3}$ Pa·s or larger, further preferably $1\times10^{-2}$ Pa·s or larger. The viscosity coefficient at 25° C. of the fluid layer is more preferably $1\times10^{2}$ Pa·s or less, further preferably 1×10 Pa·s or less. The surface tension of the fluid layer at 25° C. is preferably 20 mN/m or larger, further preferably 30 mN/m or larger.

A viscosity coefficient of the fluid layer can be measured by a rotary viscosity meter, for example. Surface tension of the fluid layer can be measured by a ring method, for example.

If the fluid layer is too high in vapor pressure, it may evaporate to make the glass vibrator non-functional. Thus, the vapor pressure of the fluid layer at 25° C. and 1 atm is preferably $1\times10^{4}$ Pa or lower, further preferably $5\times10^{3}$ Pa or lower and still further preferably $1\times10^{3}$ Pa or lower. In the case where the vapor pressure is high, the fluid layer may be, for example, sealed to prevent its evaporation. In this case, it is necessary to prevent a sealing member from obstructing vibration of the glass vibrator.

From the viewpoints of maintenance of high stiffness and transmission of vibration, it is preferable that the fluid layer be as thin as possible. More specifically, in the case where the total thickness of the pair of glass sheets is 1 mm or less, the thickness of the fluid layer is preferably 1/10 or less, more preferably 1/20 or less, still more preferably 1/30 or less, yet still more preferably 1/50 or less, even still more preferably 1/70 or less, even yet still more preferably 1/100 or less, of the total thickness of the two glass sheets. In the case where the total thickness of the pair of glass sheets exceeds 1 mm, the thickness of the fluid layer is preferably 100 μm or less, more preferably 50 μm or less, still more preferably 30 μm or less, yet still more preferably 20 μm or less, even still more preferably 15 μm or less, even yet still more preferably 10 μm or less. As for the lower limit, the thickness of the fluid layer is preferably 0.01 μm or greater from the viewpoints of the ease of film formation and durability.

It is preferable that the fluid layer be chemically stable and not react with the pair of glass sheets located on the two respective sides of it. The expression "chemically stable" means that, for example, the fluid layer is less prone to be changed in quality (degraded) or not prone to solidify, vaporize, decompose, change in color, chemically react with glass, or undergo a like change at least in a temperature range of −20° C. to 70° C.

Examples of ingredients usable as the liquid layer include water, oils, organic solvents, liquid polymers, ionic liquids, and mixtures of two or more of these. More specific examples are propylene glycol, dipropylene glycol, tripropylene glycol, straight silicone oil (dimethyl silicone oil, methylphenyl silicone oil, and methyl hydrogen silicone oil), modified silicone oil, an acrylic acid-based polymer, liquid butadiene, a glycerin paste, a fluorine-based solvent, a fluorine-based resin, acetone, ethanol, xylene, toluene, water, mineral oil, and a mixture thereof. It is preferable to contain, among these examples, at least one substance selected from the group consisting of propylene glycol, dimethyl silicone oil, methylphenyl silicone oil, methyl hydrogen silicone oil, and modified silicone oil. It is more preferable that the liquid layer contain propylene glycol or silicone oil as a main component.

In addition to the above substances, powder-dispersed slurry can be used as the fluid layer. Whereas from the viewpoint of increasing the loss coefficient, the fluid layer is preferably a uniform fluid, the above slurry is effective in the case of giving the glass vibrator a design feature or functionality such as coloration or fluorescence. The powder content in the fluid layer is preferably 0-10 volume %, even preferably 0-5 volume %. From the viewpoint of preventing sedimentation, the particle diameter of the powder is preferably 10 nm to 1 μm, even preferably 0.5 μm or less.

From the viewpoint of adding a design feature or functionality, the fluid layer may contain a fluorescent material. In this case, the fluid layer may be a slurry-like fluid layer in which a fluorescent material is dispersed in the form of a powder or a uniform fluid layer in which a fluorescent material is mixed in the form of a liquid. This makes it possible to give the glass vibrator optical functions such as light absorption and emission.

Figure 5:
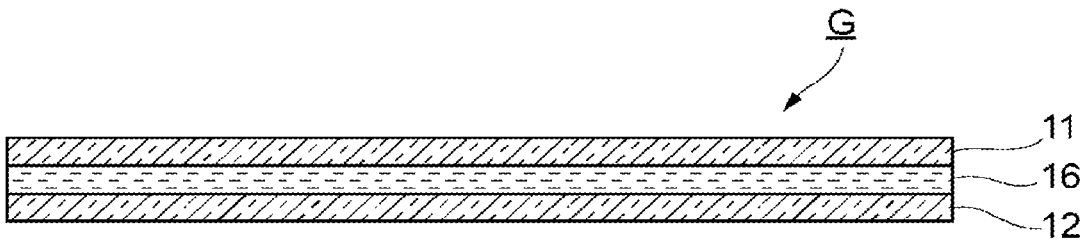
FIG. 5 illustrates a sectional view showing a specific example of the glass vibrator.

FIG. 5 is a sectional view showing a specific example of the glass vibrator G. In the glass vibrator G, it is preferable that at least a pair of glass sheets 11 and 12 be provided in such a manner that the fluid layer 16 is sandwiched between the pair of glass sheets 11 and 12 from both sides. The fluid layer 16 prevents the glass sheet 12 from resonating with the glass sheet 11 or attenuates resonance vibration of the glass sheet 12, when resonance occurs in the glass sheet 11. The presence of the fluid layer 16 can make the loss coefficient of the glass vibrator G larger than in the case that the glass sheet is provided solely.

It is preferable that the loss coefficient of the glass vibrator G be as large as possible because vibration is attenuated more. The loss coefficient at 25° C. of the glass vibrator G is preferably $1\times10^{-2}$ or larger, even preferably $2\times10^{-2}$ or larger and further preferably $5\times10^{-2}$ or larger. Since the reproducibility of radio-frequency sound when the glass vibrator G is used as a diaphragm is increased as the acoustic velocity increases, the longitudinal wave acoustic velocity of the glass vibrator G in the thickness direction be $5.0\times10^{3}$ m/s or higher, even preferably $5.5\times10^{3}$ m/s or higher and further preferably $6.0\times10^{3}$ m/s or higher. Although there are no particular limitations on the upper limit, the longitudinal wave acoustic velocity of the glass vibrator Gin the thickness direction is preferably $7.0\times10^{3}$ m/s or lower.

The glass vibrator G can be used as a light-transmissive member if its straight transmittance is high. Thus, the visible light transmittance as measured according to JIS-R3106-1998 is preferably 60% or higher, even preferably 65% or higher and further preferably 70% or higher. Example uses as a light-transmissive member are a transparent speaker, a transparent microphone, and an opening member for construction or vehicles.

It is also useful to make refraction index matching to increase the transmittance of the glass vibrator G. That is, it is preferable that the refractive indices of the glass sheet and the refractive index of the fluid layer constituting the glass vibrator G be as close to each other as possible because the reflection and interference at the interfaces can be reduced. In particular, the differences between the refractive index of the fluid layer and the refractive indices of the pair of glass sheets that are in contact with the fluid layer are preferably both 0.2 or less, even preferably 0.1 or less and further preferably 0.01 or less.

(Glass Sheets)

It is possible to color at least one of the fluid layer 16 and at least one of the glass sheets that constitute the glass vibrator G. This is useful when it is desired to give the glass vibrator G a design feature or functionality such as IR blocking, UV blocking, or a privacy glass function.

It is preferable that, of the pair of glass sheets including glass sheets 11 and 12, one glass sheet 11 and the other glass sheet 12 have different peak top value of resonance frequency. It is even preferable that the resonance frequency ranges do not overlap with each other. However, even if the resonance frequency ranges of the glass sheets 11 and 12 overlap with each other or their peak top values are the same, because of the presence of the fluid layer 16, resonance of one glass sheet 11 is not synchronized with vibration of the other glass sheet 12. As a result, resonance is canceled out to some extent, whereby a larger loss coefficient can be obtained than in the case of only the glass sheets.

That is, it is preferable that the following Formula 1 be satisfied, where Qa and wa are the resonance frequency (peak top) and the half width of resonance amplitude of the glass sheet 11, respectively, and Qb and wb are the resonance frequency (peak top) and the half width of resonance amplitude of the glass sheet 12, respectively:

$$(wa+wb)/4<|Qa-Qb|. \quad \text{[Formula 1]}$$

The difference between the resonance frequencies of the glass sheets 11 and 12 (|Qa−Qb|) increases to provide a large loss coefficient as the value of the left side of Formula 1 becomes larger, which is preferable.

Thus, it is even preferable that the following Formula 2 be satisfied and it is further preferable that the following Formula 3 be satisfied:

$$(wa+wb)/2<|Qa-Qb| \quad \text{[Formula 2]}$$

$$(wa+wb)/1<|Qa-Qb. \quad \text{[Formula 3]}$$

A resonance frequency (peak top) and a half width of resonance amplitude of each glass sheet can be measured by the same method as a loss coefficient of each glass sheet is.

The mass difference between the glass sheets 11 and 12 is preferably as small as possible, and it is even preferable that they have no mass difference. This is because where the glass sheets have a mass difference, resonance of a lighter glass sheet can be suppressed by a heavier glass sheet but it is difficult to suppress resonance of the heavier glass sheet by the lighter glass sheet. That is, where the mass ratio deviates from 1 to some extent, in principle resonance vibration of one and that of the other cannot cancel out each other because of a difference in inertial force.

The mass ratio between the glass sheets 11 and 12 that is given by (glass sheet 11)/(glass sheet 12) is preferably 0.8 to 1.25 (8/10 to 10/8), even preferably 0.9 to 1.1 (9/10 to 10/9) and further preferably 1.0 (10/10).

As the glass sheets 11 and 12 become thinner, they can come close to each other more easily via the fluid layer and can be vibrated with smaller energy. Thus, for use as a diaphragm of a speaker or the like, it is preferable that the glass sheets 11 and 12 be as thin as possible. More specifically, the thickness of each of the glass sheets 11 and 12 is preferably 15 mm or less, more preferably 10 mm or less, still more preferably 5 mm or less, yet still more preferably 3 mm or less, even still more preferably 1.5 mm or less, even yet still more preferably 0.8 mm or less. On the other hand, if the glass sheets 11 and 12 are too thin, influences of surface defects of the glass sheets 11 and 12 become so remarkable that they become prone to fracture or become difficult to treat for strengthening. Therefore, the thickness of each of the glass sheets 11 and 12 is preferably 0.01 mm or larger, further preferably 0.05 mm or larger.

In uses as an opening member for construction or vehicles in which generation of abnormal sound due to a resonance phenomenon should be suppressed, the thickness of each of the glass sheets 11 and 12 is preferably 0.5 to 15 mm, even preferably 0.8 to 10 mm and further preferably 1.0 to 8 mm. In uses as a glass substrate for a magnetic recording medium that is enhanced in the anti-vibration property, the thickness of each of the glass sheets 11 and 12 is preferably 0.3 to 1.2 mm, even preferably 0.4 to 1.0 mm and further preferably 0.5 to 0.8 mm.

It is preferable for use as a diaphragm that at least one of the glass sheets 11 and 12 have a large loss coefficient because the glass vibrator G exhibits a high degree of attenuation of vibration. More specifically, the loss coefficient at 25° C. of at least one of the glass sheets 11 and 12 is preferably $1\times10^{-4}$ or larger, even preferably $3\times10^{-4}$ or larger and further preferably $5\times10^{-4}$ or larger. Although there are no particular limitations on the upper limit, the loss coefficient at 25° C. is preferably $5\times10^{-3}$ or less. Furthermore, the loss coefficients of both of the glass sheets 11 and 12 is preferably in the above range. A loss coefficient of a glass sheet can be measured by the same method as a loss coefficient of the glass vibrator G is.

It is preferable for use as a diaphragm that at least one of the glass sheets 11 and 12 is high in the longitudinal wave acoustic velocity in the thickness direction because the reproducibility of sound in a radio frequency range is increased. More specifically, the longitudinal wave acoustic velocity of the glass sheet is preferably $5.0\times10^3$ m/s or higher, even preferably $5.5\times10^3$ m/s or higher and further preferably $6.0\times10^3$ m/s or higher. Although there are no particular limitations on the upper limit, the longitudinal wave acoustic velocity is preferably $7.0\times10^3$ m/s or lower from the viewpoints of the productivity and the material cost of the glass sheets. It is more preferable that both the glass sheets 11 and 12 satisfy the acoustic velocity value mentioned above. An acoustic velocity of each glass sheet can be measured by the same method as a longitudinal wave acoustic velocity of the glass vibrator is.

Although there are no particular limitations on the composition of the glass sheets 11 and 12, the composition is preferably in the following component ranges: $SiO_2$: 40-80 mass %, $Al_2O_3$: 0-35 mass %, $B_2O_3$: 0-15 mass %, MgO: 0-20 mass %, CaO: 0-20 mass %, SrO: 0-20 mass %, BaO: 0-20 mass %, $Li_2O$: 0-20 mass %, $Na_2O$: 0-25%, $K_2O$: 0-20 mass %, $TiO_2$: 0-10 mass %, and $ZrO_2$: 0-10 mass %. And the total content of the above substances should account for 95 mass % or more of the entire glass.

Even preferable component ranges of the composition of the glass sheets 11 and 12 (as represented by mass % based on oxides) is as follows: $SiO_2$: 55-75 mass %, $Al_2O_3$: 0-25 mass %, $B_2O_3$: 0-12 mass %, MgO: 0-20 mass %, CaO: 0-20 mass %, SrO: 0-20 mass %, BaO: 0-20 mass %, $Li_2O$: 0-20 mass %, $Na_2O$: 0-25%, $K_2O$: 0-15 mass %, $TiO_2$: 0-5 mass %, and $ZrO_2$: 0-5 mass %. And the total content of the above substances should account for 95 mass % or more of the entire glass.

Each of the glass sheets 11 and 12 can be vibrated with smaller energy as its specific gravity decreases. More specifically, the specific gravity of each of the glass sheets 11 and 12 is preferably 2.8 or less, even preferably 2.6 or less and further preferably 2.5 or less. Although there are no particular limitations on the lower limit, the specific gravity is preferably 2.2 or larger. The stiffness of each of the glass sheets 11 and 12 increases as the specific modulus of elasticity obtained by dividing the Young's modulus by the density of the glass sheets 11 and 12 becomes larger. More specifically, the specific modulus of elasticity of each of the glass sheets 11 and 12 is preferably $2.5\times10^7$ $m^2/s^2$ or larger, even preferably $2.8\times10^7$ $m^2/s^2$ or larger and further preferably $3.0\times10^7$ $m^2/s^2$ or larger. Although there are no particular limitations on the upper limit, the specific modulus of elasticity is preferably $4.0\times10^7$ $m^2/s^2$ or less.

Figure 6:
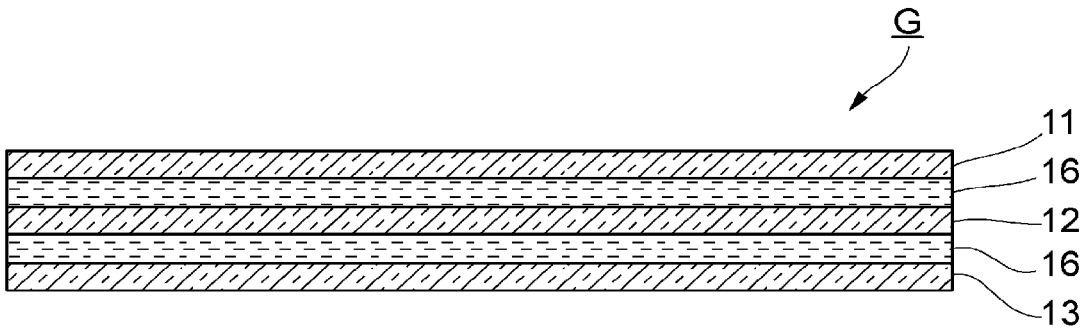
FIG. 6 illustrates a sectional view showing another example of the glass vibrator.

Whereas the number of glass sheets constituting the glass vibrator G is two or more, three or more glass sheets may be used as shown in FIG. 6. The glass sheets 11 and 12 in the case of two glass sheets or the glass sheets 11 to 13 in the case of three or more glass sheets may be such that all of them have different compositions, all of them have the same composition, or they are a combination of glass sheets having the same composition and a glass sheet(s) having another composition. In particular, it is preferable from the viewpoint of attenuation of vibration to use two or more kinds of glass sheets having different compositions. Likewise, in mass or thickness, all of the glass sheets may be either the same or different from each other or part of the glass sheets may be different from the other ones. It is preferable in terms of attenuation of vibration that all of the constituent glass sheets have the same mass.

A physically strengthened glass sheet or a chemically strengthened glass sheet can be used as at least one of the glass sheets constituting the glass vibrator G. This is useful in preventing destruction of the glass vibrator G which is a glass sheet composite. To increase the strength of the glass vibrator G, it is preferable that the glass sheet that provides its outermost surface be a physically strengthened glass sheet or a chemically strengthened glass sheet. It is even preferable that all the constituent glass sheets be physically strengthened glass sheets or chemically strengthened glass sheets.

Using crystallized glass or phase-separated glass as the glass sheet is useful in increasing the longitudinal wave acoustic velocity or strength. In particular, when it is desired to increase the strength of the glass vibrator G which is a glass sheet composite, it is preferable that the glass sheet that provides its outermost surface be made of crystallized glass or phase-separated glass.

Figure 7:
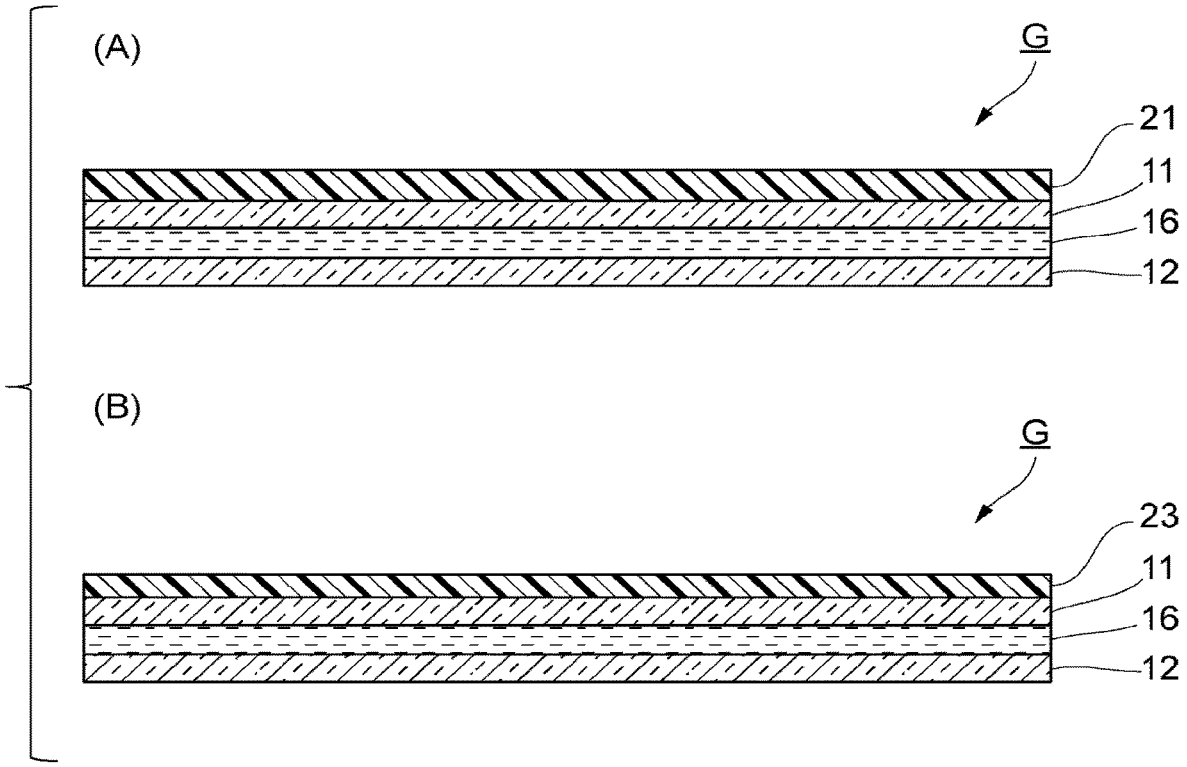
FIG. 7 illustrates sectional views; (A) and (B) are sectional views showing other examples of the glass vibrator.

In the glass vibrator G, a coating layer 21 shown in (A) of FIG. 7 or a film 23 shown in (B) of FIG. 7 may be formed on at least one the outermost surface of the glass sheet composite within the confines that the advantages of the invention are not lowered. The formation of the coating layer 21 and the sticking of the film 23 are suitable to, for example, prevent scratches. The thickness of the coating layer 21 or the film 23 is preferably ⅕ or less of that the thickness of the surface glass sheet. The coating layer 21 and the film 23 may be known ones. Examples of the coating layer 21 include a water-repellent coating, a hydrophilic coating, a water-slidable coating, an oil-repellent coating, an antireflection coating, and a thermal barrier coating. Examples of the film 23 include a glass scattering prevention film, a color film, a UV blocking film, IR blocking film, a heat-shielding film, and an EM-shielding film.

(Sealing Member)

Figure 8:
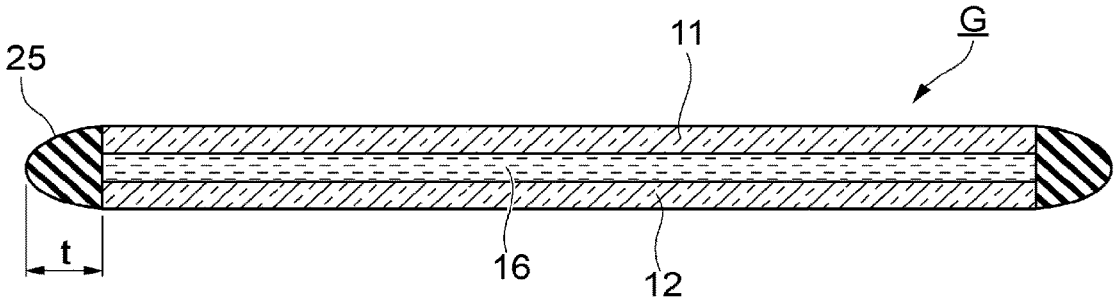
FIG. 8 illustrates a sectional view showing a glass vibrator having a sealing member in the end portion.

As shown in FIG. 8, at least a part of the outer circumferential end surface of the glass vibrator G may be sealed with a sealing member 25 that does not obstruct vibration of the glass vibrator G. The sealing member 25 may be made of a highly elastic rubber, resin, gel, or the like.

Example of resins that can be used for the sealing member 25 include an acrylic resin, a cyanoacrylate resin, an epoxy resin, a silicone resin, a urethane resin, and a phenol resin. Example setting methods are of a single liquid type, a two-liquid mixing type, a heat setting type, an ultraviolet setting type, and a visible light setting type. A hot-melt resin can also be used. Example of the materials include of an ethylene acetate vinyl type, a polyolefin type, a polyamide type, a synthetic rubber type, an acrylic type, and a polyurethane type. Examples of rubber include natural rubber, synthetic natural rubber, butadiene rubber, styrene-butadiene rubber, butyl rubber, nitrile rubber, ethylene-propylene rubber, chloroprene rubber, acrylic rubber, chlorosulfonated polyethylene rubber (Hypalon), urethane rubber, silicone rubber, fluororubber, ethylene-vinyl acetate rubber, epichlorohydrin rubber, polysulfide rubber (Thiokol), and hydrogenated nitrile rubber. When the thickness t of the sealing member 25 is too small, sufficient strength cannot be secured. When the thickness t is too thick, the sealing member 25 obstructs vibration. Thus, the thickness t of the sealing member 25 is preferably 10 μm or greater and less than or equal to five times the total thickness of the glass sheet composite. The thickness t of the sealing member 25 is even preferably 50 μm or greater and less than the total thickness of the glass sheet composite.

Figure 9:
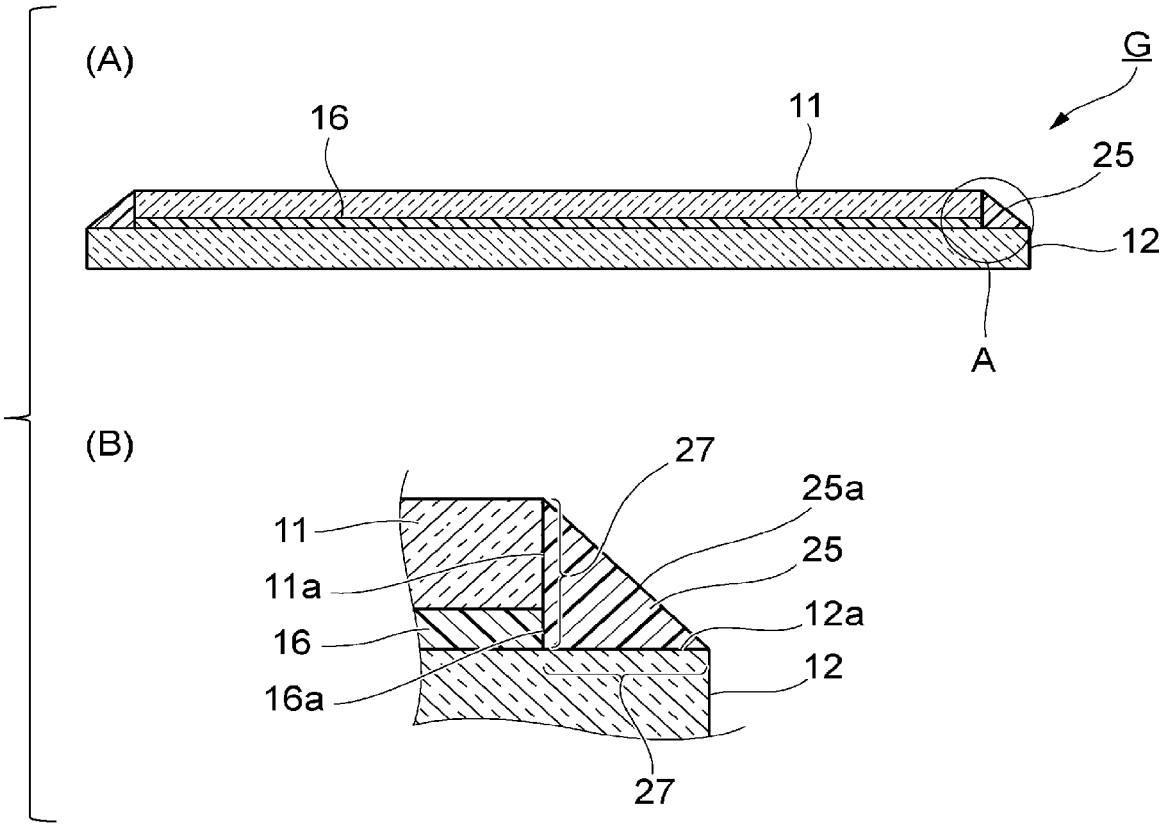
FIG. 9 illustrates a sectional view and an enlarged view; (A) is a sectional view showing a glass vibrator having a step portion in its end portions, and (B) is an enlarged view of part A in (A).

As shown in (A) and (B) of FIG. 9, in the glass vibrator G, the glass sheets 11 and 12 have been disposed so that an edge surface of the two glass sheets are not flush with each other to constitute a step portion 27 having a stair-like shape in a cross-sectional view. A sealing member 25 is formed in the step portion 27 so as to seal at least the fluid layer 16.

In the step portion 27, the sealing member 25 is in close contact with an end surface 11*a* of the glass sheet 11, an end surface 16*a* of the fluid layer 16, and part of a major surface 12*a* of the glass sheet 12. With this structure, the fluid layer 16 is sealed with the sealing member 25, whereby leakage from the fluid layer 16 can be prevented. Furthermore, the joining between the glass sheet 11, the fluid layer 16, and the glass sheet 12 is strengthened, whereby the glass vibrator G is increased in strength.

Furthermore, in the step portion 27, the end surface 11*a* of the glass sheet 11 and the end surface 16*a* of the fluid layer 16 are perpendicular to the major surface 12*a* of the glass sheet 12. As a result, in a sectional view, the sealing member 25 has an outline that extends along the step portion 27 so as to assume an L shape. With this structure, the joining between the glass sheet 11, the fluid layer 16, and the glass sheet 12 is strengthened further, whereby the glass vibrator G is increased further in strength.

The sealing member 25 has a tapered surface 25*a*. In some case, the edge of the glass vibrator G is tapered or subjected to like working. The employment of the sealing member 25 having the above shape can provide the same effect as in the case where the glass vibrator G is worked in such a manner.

In addition, in the glass vibrator G, the end surfaces of the glass sheets 11 and 12 are not flush with each other and the sealing member 25 is formed in the step portion 27. Thus, in the glass vibrator G, the sealing member 25 is located behind the glass sheet 12 and hence is not seen when viewed from the side of the glass sheet 12. This enhances the design performance of the glass vibrator G.

Figure 10:
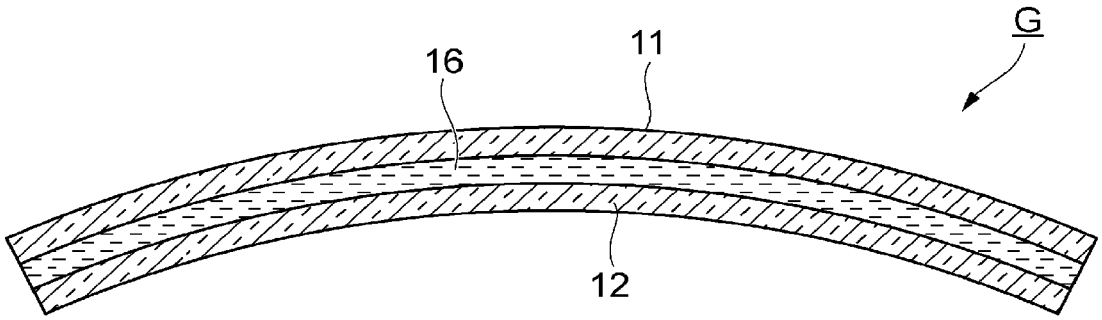
FIG. 10 illustrates a sectional view showing a curved glass vibrator.

The glass vibrator G may have a planar shape or such a curved shape (see FIG. 10) as to be curved (bent) to conform to an installation place. Alternatively, although not shown in any drawing, the glass vibrator G may be shaped so as to have both of a planar portion and a curved portion. That is, the glass vibrator G may have a three-dimensional shape including a curved portion that is curved to assume a concave shape or a convex shape at least partially. By having a three-dimensional shape that conforms to an installation place, it can be given a good appearance in the installation place and hence can be enhanced in design performance.

Figure 11:
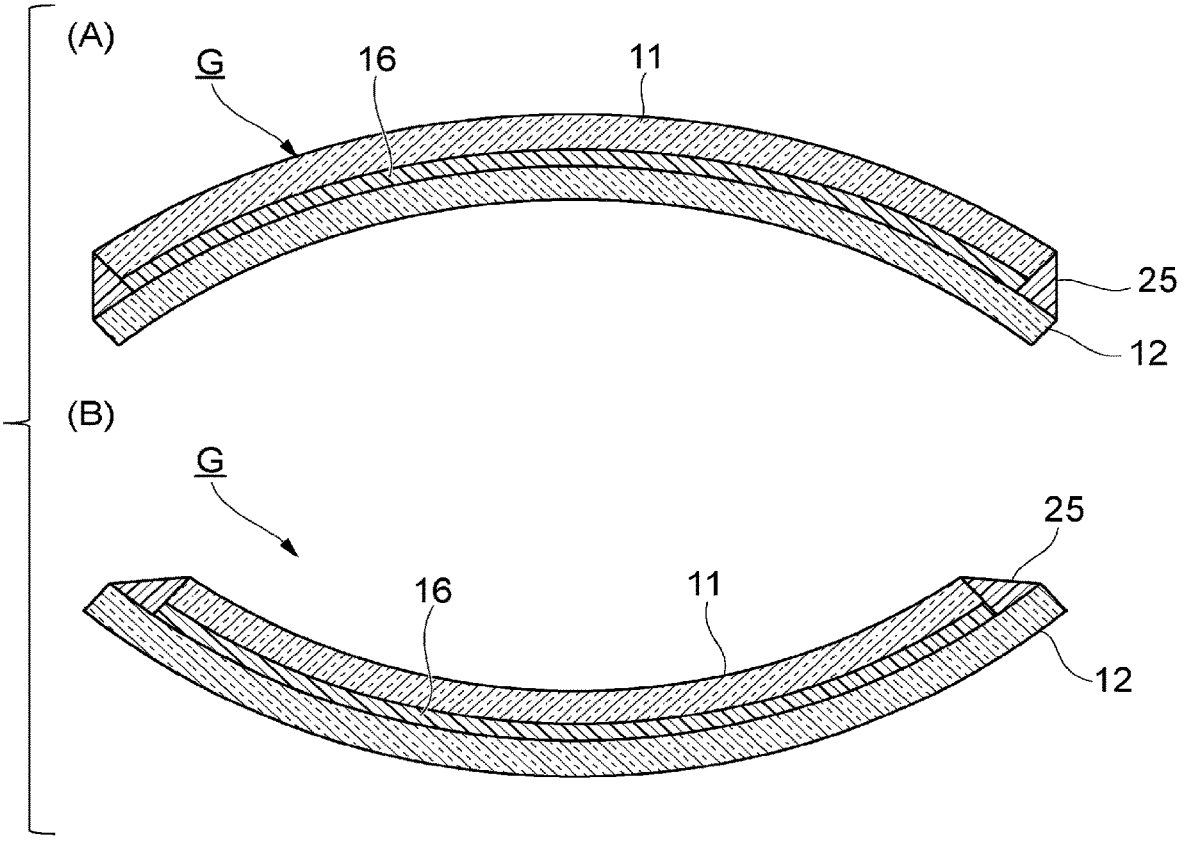
FIG. 11 illustrates sectional views of a glass vibrator having a step portion in end portions; (A) and (B) are sectional views showing glass vibrators that are curved so as to assume a concave shape and a convex shape, respectively.

Furthermore, the glass vibrator G in which the outer edge step portion 27 is sealed with the sealing member 25 may be given a curved shape (three-dimensional shape) so that the glass sheet 12 side is recessed as shown in (A) of FIG. 11. In this case, an outer edge of the glass sheet 12 projects outward beyond the glass sheet 11. Alternatively, as shown in (B) of FIG. 11, the glass vibrator G may be given a curved shape that is an inverted version of the shape shown in (A) of FIG. 11. Also in this case, an outer edge of the glass sheet 12 projects outward beyond the glass sheet 11.

Also in these glass vibrators G, the sealing member 25 is located behind the glass sheet 12 and hence is not seen when viewed from the side of the glass sheet 12. As a result, each glass vibrator G can be given a good appearance in an installation place and hence can be enhanced in the design performance of itself.

<Application Examples of Vibration Device>

Making good use of the fact that the major surfaces are given a wide area, in, a case that the glass vibrator G is light-transmissive, the vibration device 100 can be used as a display by disposing a display screen on the deep side in the viewing direction (the direction Va shown in (A) of FIG. 1). It is also possible to give the vibration device 100 a display function by providing a surface of the glass vibrator G with light-emitting elements. Furthermore, the vibration device 100 can be added with a function of displaying video by sticking a screen film to the glass vibrator G and projecting the video onto it. Further, the vibration device 100 can be used as a window glass.

Application examples of the vibration device 100 having the above-described configuration is described below.

For example, the vibration device 100 can be used as a member of an electronic device, examples of which are a full-range speaker, a speaker for reproduction of bass sound in a 15-200 Hz range, a speaker for reproduction of treble sound in a 10-100 kHz range, a large-size speaker having a diaphragm area of 0.2 $m^2$ or larger, a small-size speaker having a diaphragm area of 3 $cm^2$ or less, a planar speaker, a cylindrical speaker, a transparent speaker, a cover glass for a mobile device that functions as a speaker, a cover glass for a TV display, a display that generates a video signal and an audio signal from the same surface, a speaker for a wearable display, an electric bulletin board, and illumination equipment. The vibration device 100 can also be used as a microphone diaphragm or a vibration sensor.

The vibration device 100 can be used as an interior vibration member of a transport machine such as a vehicle or a vehicular or onboard speaker. For example, the vibration device 100 can be used as each of various kinds of interior panels functioning as a speaker, such as a side-view mirror, a sunvisor, an instrument panel, a dashboard, a ceiling, and a door. Each of these panels can also be used so as to function as a microphone or a diaphragm for active noise control.

For example, the vibration device 100 can be used as an opening member used in, for example, a construction or transport machine. In this case, it is possible to add such a function as IR blocking, UV blocking, or coloration to the diaphragm.

In the case where the vibration device 100 is used as part of an opening member, exciters E may be attached to the major surface on one or both sides of the glass vibrator G. This configuration makes it possible to easily reproduce sound in a radio-frequency range that has been difficult to reproduce so far. Furthermore, the vibration device 100 can provide an opening member that is superior in design performance because it is high in the degree of freedom of selection of size, shape, color, etc. of the glass vibrator G and hence can be added with a design feature.

A sound pickup microphone or a vibration detector disposed on the surface of or in the vicinity of the glass vibrator G can sample a sound or vibration and amplify or cancel out the sampled sound or vibration by causing the diaphragm to generate vibration that is the same as or opposite to the sampled sound or vibration in phase.

More specifically, the vibration device 100 can be applied to each of a speaker installed inside or outside a vehicle and a vehicular windshield, side window glass, rear window glass, and roof glass having a sound insulation function. The vibration device 100 can also be used as each of a vehicular window glass, a structural member, and a decorative plate that are improved in water repellency, snow accretion resistance, ice accretion resistance, or an antifouling property by sound wave vibration. More specifically, the vibration device 100 can be used as each of a lens and a sensor and a cover glass thereof in addition to a vehicular window glass and mirror.

Opening members for construction include a window glass, a door glass, and a roof glass, an interior member, an exterior member, a structural member, an outer wall, and a cover glass for a solar battery each of which can function as a diaphragm or a vibration detection device. Each of them may be used as a sound reflection (reverberation) board.

Furthermore, water repellency, snow accretion resistance, and the antifouling property (mentioned above) can be enhanced by sound wave vibration.

(Examples of Application of Vibration Device to Speaker Unit)

Figure 12:
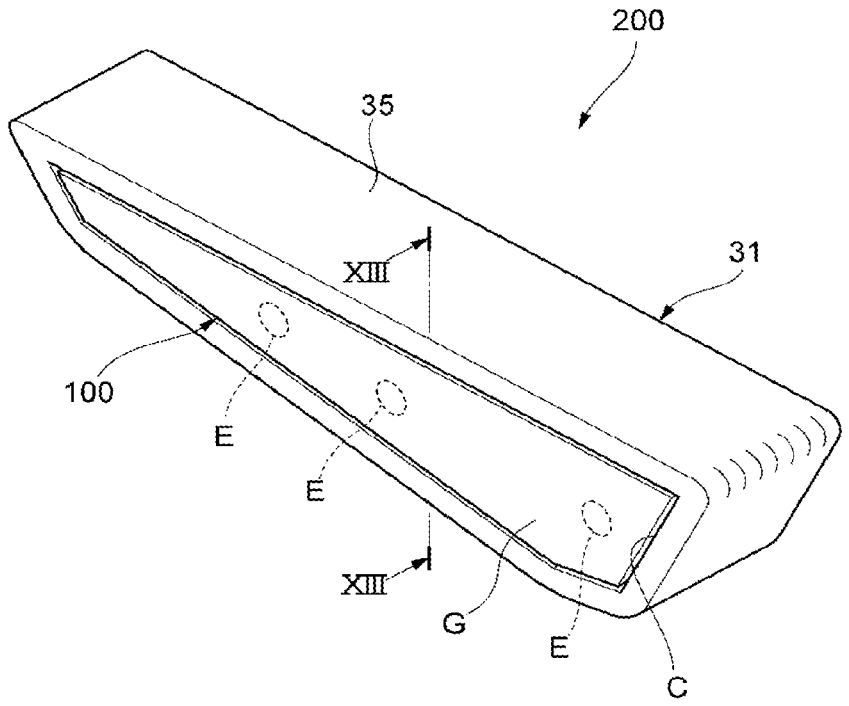
FIG. 12 illustrates a perspective view of a speaker unit in which a vibration device is incorporated in a housing.
Figure 13:
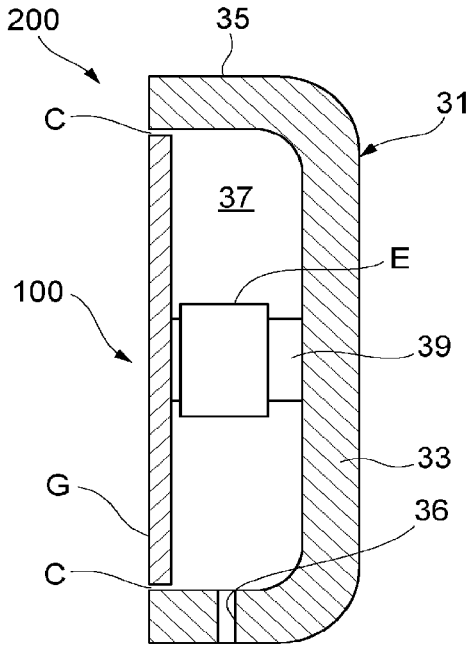
FIG. 13 illustrates a sectional view taken along line XIII-XIII in FIG. 12.

FIG. 12 is a perspective view of a speaker unit in which a vibration device is incorporated in a housing. FIG. 13 is a sectional view taken along line XIII-XIII in FIG. 12.

As shown in FIG. 12 and FIG. 13, the vibration device 100 can be used as a speaker unit 200. The speaker unit 200 has a housing 31 that is recessed so as to hold the glass vibrator G.

The housing 31 has a bottom plate 33 and a circumferential wall 35 which projects from the circumferential portion of the bottom plate 33. The vibration device 100 is inserted into an internal space 37, surrounded by the bottom plate 33 and the circumferential wall 35, of the housing 31 from the exciter E side. As a result, the housing 31 surrounds the outer circumferential surface of the glass vibrator G while the exciters E are disposed in the internal space 37.

It is preferable that one side of each exciter E be fixed to the glass vibrator G and the other side be fixed to the housing 31. As shown in FIG. 13, a support member 39 made of a metal, a resin, or the like may be disposed between the exciter E and the housing 31. Since the exciter E is in contact with the housing 31, a sound pressure that is generated on the back side of the glass vibrator G can be reduced in the internal space 37 of the housing 31. The other side of the exciter E need not be fixed to the housing 31.

Since the vibration device 100 is received in the housing 31, the outer circumferential surface of the glass vibrator G is disposed so as to be spaced from the inner circumferential surface of the circumferential wall 35 by a gap C, and the surface of the glass vibrator G is approximately flush with an end surface 35*a* of the circumferential wall 35. That is, the glass vibrator G is supported by the housing 31 via the exciters E and hence are not in direct contact with the housing 31. This makes it possible to prevent vibration of the glass vibrator G from being attenuated by interference with the housing 31.

An air hole 36 that allows the internal space 37 of the housing 31 to communicate with the outside of the housing 31 may be formed in the circumferential wall 35 of the housing 31. The air hole 36 reduces the pressure difference between the internal space 37 of the housing 31 and the outside of the housing 31 while the glass vibrator G is vibrating and serves as a silencer for sound that is generated from the back surface of the glass vibrator G. Furthermore, since the speaker unit 200 has the structure that the back surface of the glass vibrator G is covered with the housing 31, sound generated from the back surface of the glass vibrator G is prevented from returning to the side of the front surface of the glass vibrator G. Further, where a sound absorbing member made of felt, sponge, or the like is stuck to the inside or outside of the housing 31, the silencing effect of the housing 31 is enhanced and sound leakage on the back side of the glass vibrator G can thereby be reduced.

Figure 14:
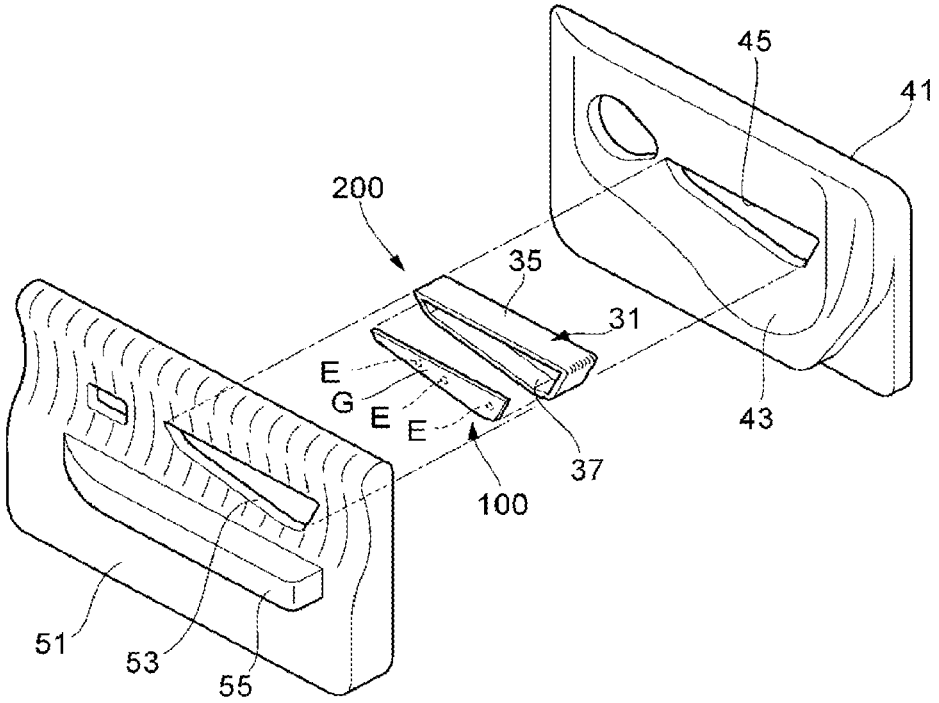
FIG. 14 illustrates an exploded perspective view of a vehicle door in which the speaker unit is incorporated.

The speaker unit 200 having the above configuration is mounted on, for example, a vehicle door 41 and can be used as an intra-vehicle speaker. As shown in FIG. 14, the vehicle door 41 has a metal door panel 43 which is a structural member and a lining interior member 51 which is attached to the door panel 43 from inside the vehicle.

An armrest 55 is provided on the vehicle inside of the interior member 51, and an opening 53 is formed on the top of the armrest 55. An attachment hole 45 is formed in an inside portion of the door panel 43.

The speaker unit 200 which is an assembly of the glass vibrator G, the exciters E, and the housing 31 is fitted into the attachment hole 45 of the door panel 43. As a result, the glass vibrator G is set in the opening 53 of the interior member 51 so as to extend across the surface of the interior member 51.

In the case where the speaker unit 200 having the vibration device 100 is employed as an intra-vehicle speaker, the vibration device 100 can be attached to the door 41 by simple work of merely attaching the assembly of the vibration device 100 and the housing 31 to the door panel 43.

Figure 15:
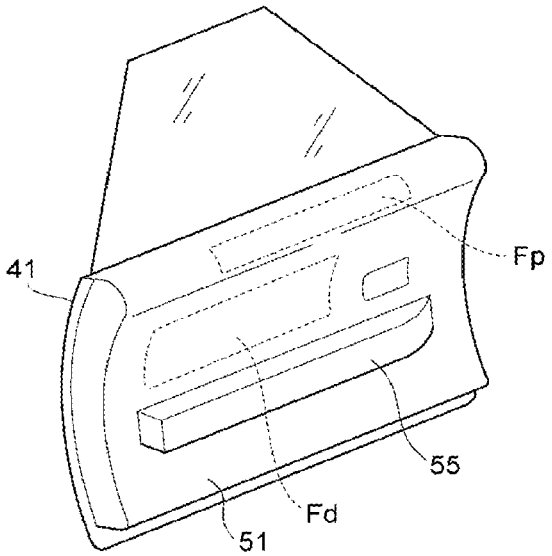
FIG. 15 illustrates a perspective view showing an example vehicle door in which the speaker unit is incorporated.

The form of installation of the speaker unit 200 is of a case that the speaker unit 200 is set in a recessed portion Fd, recessed toward the outside of the vehicle, of the interior member 51 of the door 41, as shown in FIG. 15. The speaker unit 200 may be set in a projected portion Fp, projecting toward the inside of the vehicle, of the interior member 51. The speaker unit 200 may be set in both of the recessed portion Fd and the projected portion Fp. In this case, enhanced functionality can be obtained by, for example, making the specifications of output frequency ranges of the speaker units 200 different from each other.

In the case where the speaker unit 200 is installed in the door 41, the glass vibrator G of the vibration device 100 is given a recessed or projected three-dimensional shape that conforms to a shape around the attachment area and hence conforms to the surface shape of the recessed portion Fd or the projected portion Fp of the interior member 51, to provide an appearance that is superior in design performance. Furthermore, since the glass vibrator G is high in the degree of freedom of selection of its size, shape, color, etc. and can easily be given a design feature, an intravehicle speaker that is superior also in design performance can be constructed.

Figure 16:
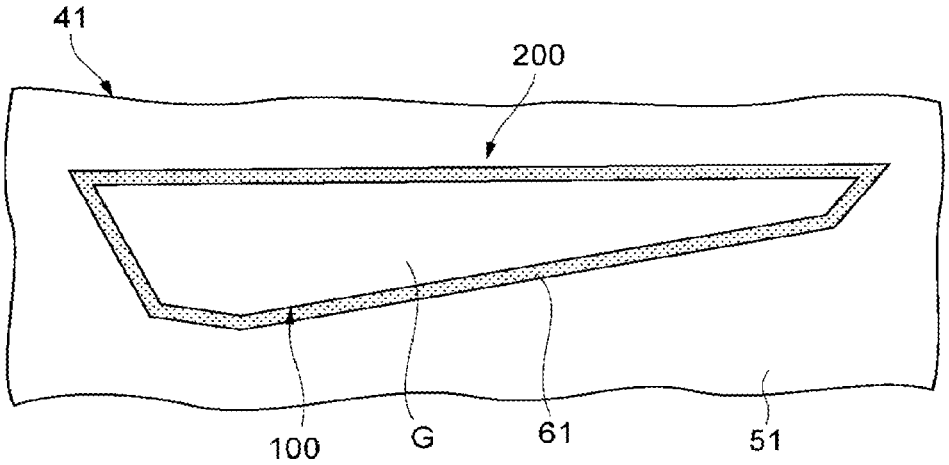
FIG. 16 illustrates a front view of part of a door in which the speaker unit is incorporated.

As shown in FIG. 16, in the case where the speaker unit 200 having the vibration device 100 is installed in the door 41, the gap between the opening 53 of the interior member 51 and the speaker unit 200 may be filled up with a film 61. This makes it possible to prevent foreign matter, dust, or the like from entering the speaker unit 200 from inside the vehicle through the gap between the opening 53 and the speaker unit 200 and to suppress leakage of sound generated on the back side of the glass vibrator G into the internal space of the vehicle.

The housing 31 of the above-described speaker unit 200 can be replaced by other things.

For example, the vibration device 100 may be received in a recessed portion formed in the door panel 43 shown in FIG. 14 instead of the housing 31. In this case, it is preferable to dispose a sound absorbing member made of felt, sponge, or the like in the door panel 43 so as to be opposed to the vibration device 100. This makes it unnecessary to prepare the above-described housing separately, whereby a manufacturing process can be simplified and the components cost can be reduced.

A portion(s) of the glass vibrator G to which the exciters E are attached may be supported by a fixed side such as the door panel 43 via an elastic body such as a rubber member or a spring member. Also in this case, the housing is not necessary and hence the configuration can be simplified.

Furthermore, the vibration device 100 may be mounted on the door 41 in such a manner that the exciters E are attached to the peripheral portion of the indoor-side surface of the glass vibrator G and disposed behind a peripheral portion, around the opening 53, of the interior member 51 so as not to be seen from inside the vehicle. In this case, the appearance is not impaired because the exciters E attached to the peripheral portion of the glass vibrator G are hidden behind the interior member 51.

The invention is not limited to the above-described embodiments. Combining together units, members, etc. employed in the embodiments and modifications and applications made by those skilled in the art on the basis of the disclosure of the specification and known techniques are expected in the invention and encompass the range of protection.

Although the present invention has been described in detail with reference to the particular embodiments, it is apparent that those skilled in the art that various changes and modifications could be made without departing from the spirit and scope of the invention. The present application is based on Japanese Patent Application No. 2018-246215 filed on Dec. 27, 2018, the disclosure of which is incorporated herein by reference.

INDUSTRIAL APPLICABILITY

In the vibration device according to the invention, the plate-like glass vibrator G that is long and narrow, that is, has a large aspect ratio, can be excited stably while sufficient acoustic performance is maintained. As such, the vibration device according to the invention can be used suitably as members for electronic devices, interior vibration members and vehicular or onboard speakers of transport machines such as vehicles, and opening members used in construction and transport machines etc.

DESCRIPTION OF SYMBOLS

11, 12: Glass sheet
16: Fluid layer

31: Housing
36: Air hole
100, 110, 120: Vibration device
E: Exciter
G: Glass vibrator
R: Reinforcement member

The invention claimed is:

1. A vibration device for generating acoustic performance, comprising:

a glass vibrator having a plate shape and including a reinforcement member; and a plurality of exciters attached to the glass vibrator and comprising circuitry configured to receive an input electrical signal from an external device and generate vibration, wherein the reinforcement member of the glass vibrator is fixed to the plurality of exciters, the glass vibrator has an aspect ratio La/Lb in a range of 1.2 to 50 where La is a length of a longer side, and Lb is a length of a shorter side of a rectangle, the plurality of exciters is positioned such that $\alpha$ is in a range of 0.2 to 0.8 where $\sigma=S_{min}(n-1)/La$, n is a number of the exciters and is 3 or larger, Smin is a minimum value of distance between the exciters and that a value $\beta$ is in a range of 0 to 0.5 where $\beta=S\sigma/S_{ave}$, $S\sigma$ is a standard deviation of distances between the exciters, and Save is an average of the distances between the exciters.

2. The vibration device according to claim 1, wherein the glass vibrator has a loss coefficient at 25° C. of $1\times10^2$ or larger, and a longitudinal wave acoustic velocity in a thickness direction of the glass vibrator of $5.0\times10^3$ m/s or higher.

3. The vibration device according to claim 2, wherein the glass vibrator comprises a plurality of glass sheets and a fluid layer comprising liquid disposed between at least a pair of glass sheets among the glass sheets.

4. The vibration device according to claim 2, further comprising:

a housing covering at least one surface of the glass vibrator such that the exciters are disposed in an internal space of the housing.

5. The vibration device according to claim 4, further comprising:

a sound absorbing member positioned in the internal space of the housing.

6. The vibration device according to claim 2, wherein the vibration device has a sound pressure variation in a frequency of 200 Hz to 10 kHz of 20 dB or less.

7. The vibration device according to claim 2, wherein at least a part of the glass vibrator has a concave or convex curved surface.

8. The vibration device according to claim 1, wherein the glass vibrator comprises a plurality of glass sheets and a fluid layer comprising liquid disposed between at least a pair of glass sheets among the glass sheets.

9. The vibration device according to claim 1, further comprising:

a housing covering at least one surface of the glass vibrator such that the exciters are disposed in an internal space of the housing.

10. The vibration device according to claim 9, wherein each of the exciters is fixed to the glass vibrator on one side and fixed to the housing on the other side.

11. The vibration device according to claim 9, wherein the housing has an air hole formed to communicate the internal space of the housing with an outside of the housing.

12. The vibration device according to claim 9, further comprising:

a sound absorbing member positioned in the internal space of the housing.

13. The vibration device according to claim 1, wherein the vibration device has a sound pressure variation in a frequency of 200 Hz to 10 kHz of 20 dB or less.

14. The vibration device according to claim 1, wherein at least a part of the glass vibrator has a concave or convex curved surface.

15. The vibration device according to claim 1, wherein the glass vibrator comprises a reinforcement member that extends along a longitudinal direction of the glass vibrator.

16. The vibration device according to claim 1, wherein each of the exciters includes a coil portion electrically connected to the external device, a magnetic portion, and an exciting portion connected to the coil portion or the magnetic portion such that the coil portion or the magnetic portion generates the vibration through interaction between the coil portion and the magnetic portion and that the vibration is transmitted to the glass vibrator through the exciting portion.

17. The vibration device according to claim 1, wherein the glass vibrator has an aspect ratio La/Lb in a range of 5.0 to 50.

18. The vibration device according to claim 1, wherein the exciters are spaced apart from each other along the long side in a longitudinal direction of the glass vibrator.

19. The vibration device according to claim 1, wherein the plurality of exciters is positioned such that a is in a range of 0.25 to 0.75.

20. The vibration device according to claim 1, wherein the plurality of exciters is positioned such that a is in a range of 0.3 to 0.7.

* * * * *